US005720604A

United States Patent [19]

Kelly et al.

[11] Patent Number: 5,720,604

[45] Date of Patent: Feb. 24, 1998

[54] FLAME DETECTION SYSTEM

[75] Inventors: Daniel L. Kelly; Craig R. Knotts, both of Fort Wayne; Larry E. Wilson, Marion, all of Ind.

[73] Assignee: Carrier Corporation, Syracuse, N.Y.

[21] Appl. No.: 732,562

[22] Filed: Oct. 15, 1996

[51] Int. Cl.[6] ..... F23N 5/20

[52] U.S. Cl. ..... 431/6; 431/25; 431/59; 340/579

[58] Field of Search ..... 431/6, 25, 59, 431/50; 340/579

[56] References Cited

U.S. PATENT DOCUMENTS 5,073,104 12/1991 Kemio ..... 340/579
5,548,277 8/1996 Wild ..... 340/579

*Primary Examiner*—Carroll B. Dority

[57] ABSTRACT

A flame sensor senses the intensity of a pilot flame to determine whether main burner ignition has occurred in a gas furnace. The sensor includes a computer which is operative to trigger the sensing of the flame intensity following the provision of gas to the main burner. Circuitry associated with the computer preferably provides an indication of the pilot flame intensity to the computer through a measurement of the electrical conductivity of the pilot flame following provision of gas to the main burner.

16 Claims, 5 Drawing Sheets

FLAME DETECTION SYSTEM

BACKGROUND OF THE INVENTION

This invention relates to the sensing of a flame produced by the pilot burner of a gas furnace preferably heating a home or office building.

It has heretofore been known to provide a sensor in the area of a pilot burner so as to sense the presence of a flame at the pilot burner. The sensing of the presence of the pilot burner flame has generally been relied upon as an assurance that the main burner of the furnace will successfully ignite when gas is provided to the main burner. Such reliance may not be correct in the event of a malfunction of the main burner itself.

OBJECTS OF THE INVENTION

It is an object of the invention to provide apparatus for accurately predicting the presence of a main burner flame through the sensing of the pilot burner flame.

SUMMARY OF THE INVENTION

The above and other objects of the invention are achieved by mounting a pilot burner close to at least one burner element of a main burner. The pilot burner preferably includes a pilot flame hood which directs a flame produced by the pilot burner toward any flame produced by the particular main burner element. A sensor associated with the pilot burner senses the intensity of the pilot flame. The intensity of the pilot flame will change significantly when the pilot flame interacts with a flame produced by the main burner at main burner ignition. The sensor includes a microprocessor which evaluates the intensity of the pilot flame to determine whether the sensed intensity indicates main burner ignition. The microprocessor is operative to initiate a shut down of the furnace in the event that main burner ignition is not detected after the pilot flame is sensed. A preferred embodiment of the sensor includes an electrode located in the pilot flame area. Circuitry associated with the electrode causes alternating current to flow through the electrode and hence through the pilot flame. The pilot flame will have a distinct increase in conductivity if successful ignition of the main burner occurs. Detection of this increased conductivity is accomplished by monitoring the build up of a voltage across a capacitor in the circuitry associated with the electrode. A timer tracks the elapsed time it takes for the capacitor to reach a particular charged voltage condition. A rapid charging of the capacitor indicates a pilot flame intensity experienced only when the main burner has been ignited.

BRIEF DESCRIPTION OF THE DRAWINGS

Other objects and advantages of the present invention will be apparent from the following description in conjunction with the accompanying drawings, in which.

DESCRIPTION OF THE PREFERRED EMBODIMENT

Figure 1:
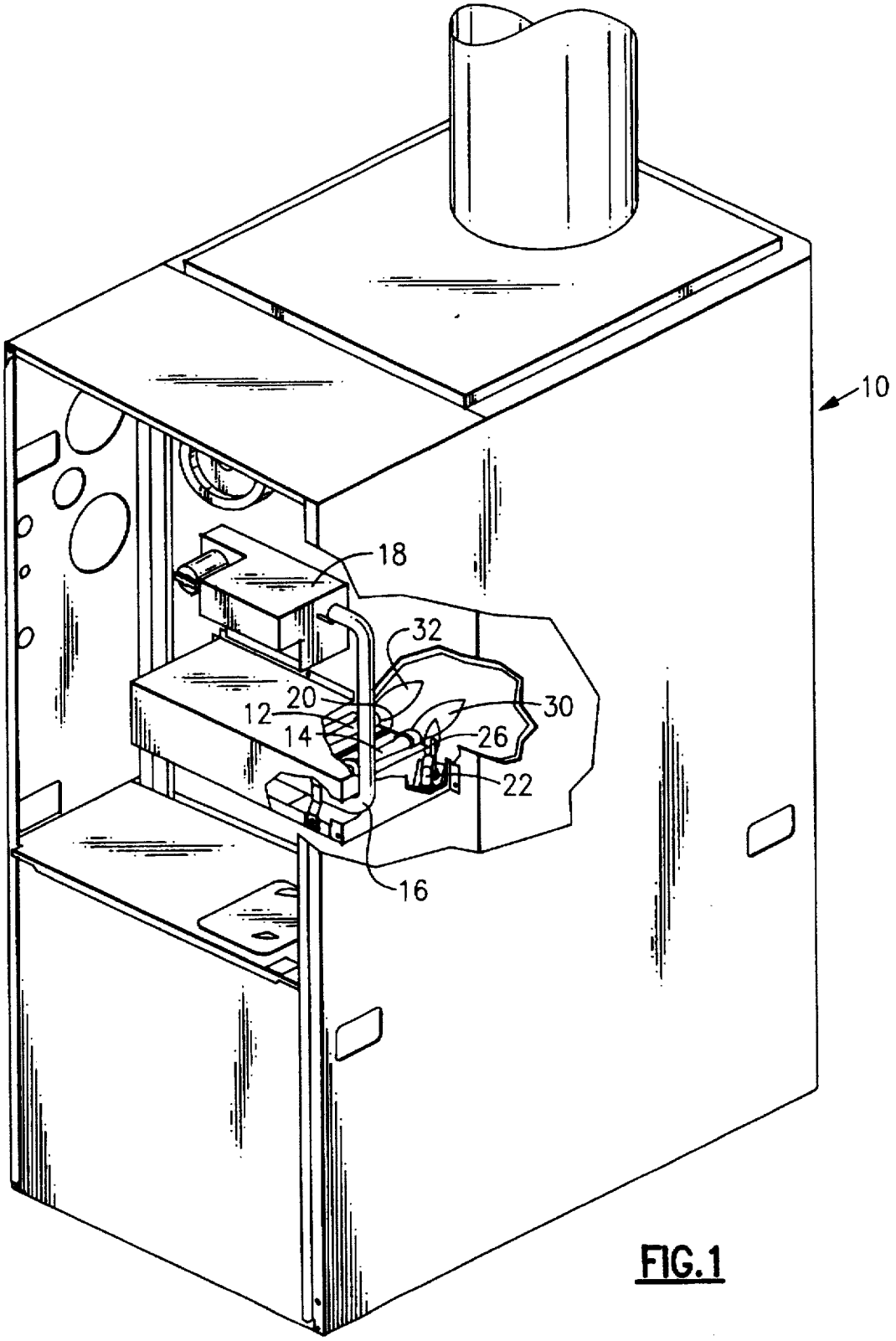
FIG. 1 illustrates a gas furnace having a main gas burner therein as well as a gas supply associated therewith.

Referring to FIG. 1, a furnace 10 includes a main burner area having burner elements 12 and 14 therein. The burner elements 12 and 14 will normally receive fuel such as natural gas via a gas line 16 when a gas valve 18 is turned on. The activation of the gas valve is in accordance with controls normally associated with the gas furnace 10.

Figure 2:
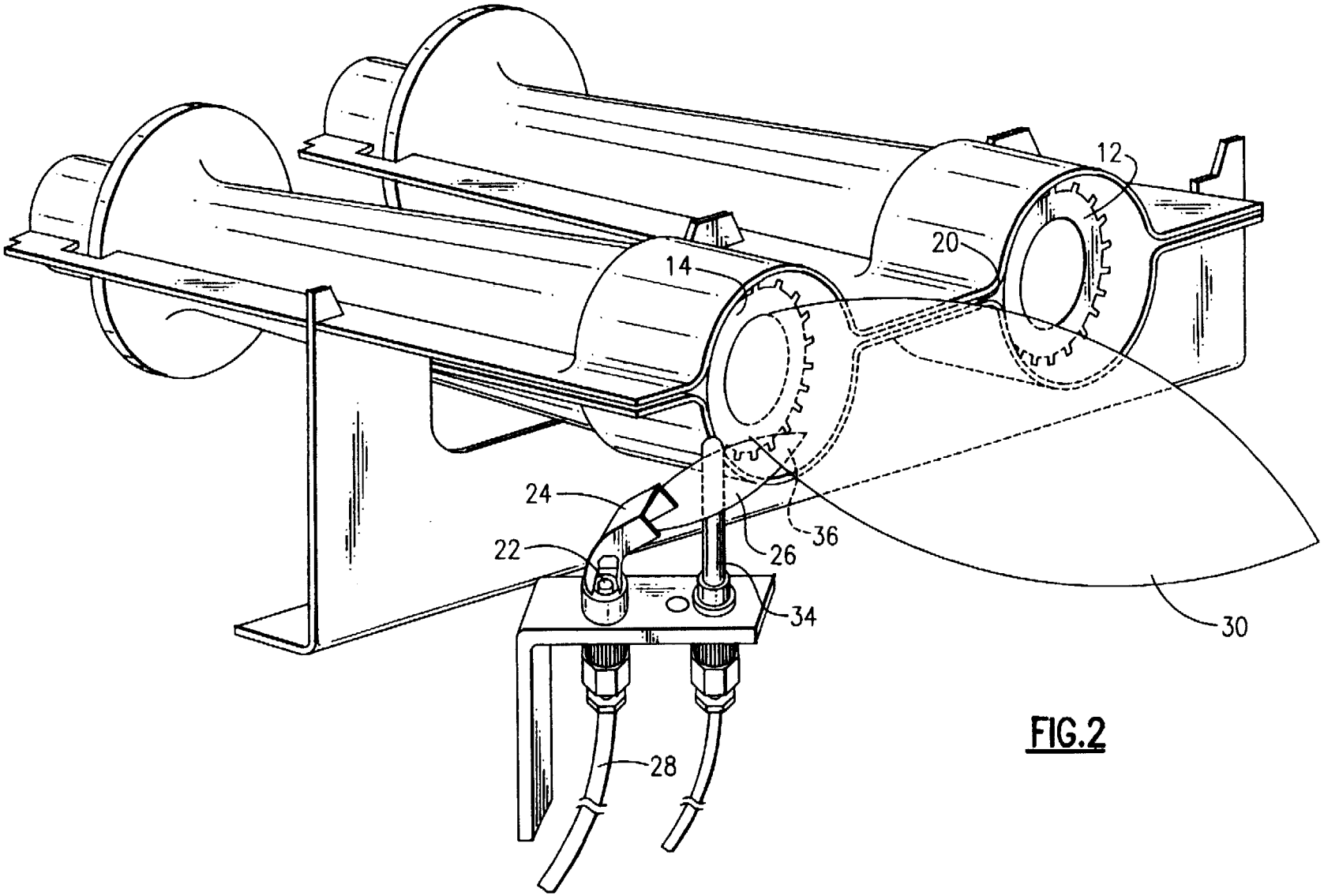
FIG. 2 is a perspective view illustrating the relationship of a pilot burner to the gas burner of FIG. 1.

Referring to FIG. 2, the gas burner elements 12 and 14 are illustrated in further detail. In particular, the gas burner elements 12 and 14, are seen to be linked together by a flame carry over channel 20. A pilot burner 22, having a hood 24 oriented toward the burner element 14, provides a pilot flame 26 having sufficient size to normally ignite any gas emanating from this burner element. The pilot burner 22 receives a supply of gas via a pilot gas line 28 whereas the burner elements receive gas via a gas line 16 when a gas valve 18 is opened. When working properly, the gas valve 18 associated with the gas line 16 will open so as to supply gas to the burner elements such as 12 and 14. The gas emanating from the burner element 14 will first be ignited by the pilot flame 26 so as to produce a burner element flame 30. The adjacent burner elements, such as 12, are thereafter quickly ignited by virtue of the flame carry over channel 20 passing the flame from the previous ignited burner element. This produces burner element flame 32, as shown in FIG. 1, as a result of the flame carry over from burner element flame 30.

Referring to the pilot flame 24, it is to be noted that a pilot flame electrode 34 extends into the path of the pilot flame. As will be explained in detail hereafter, circuitry associated with the electrode 34 senses a change in the intensity of the flame 26 occurring when the burner element 14 ignites producing the burner element flame 30.

Figure 3:
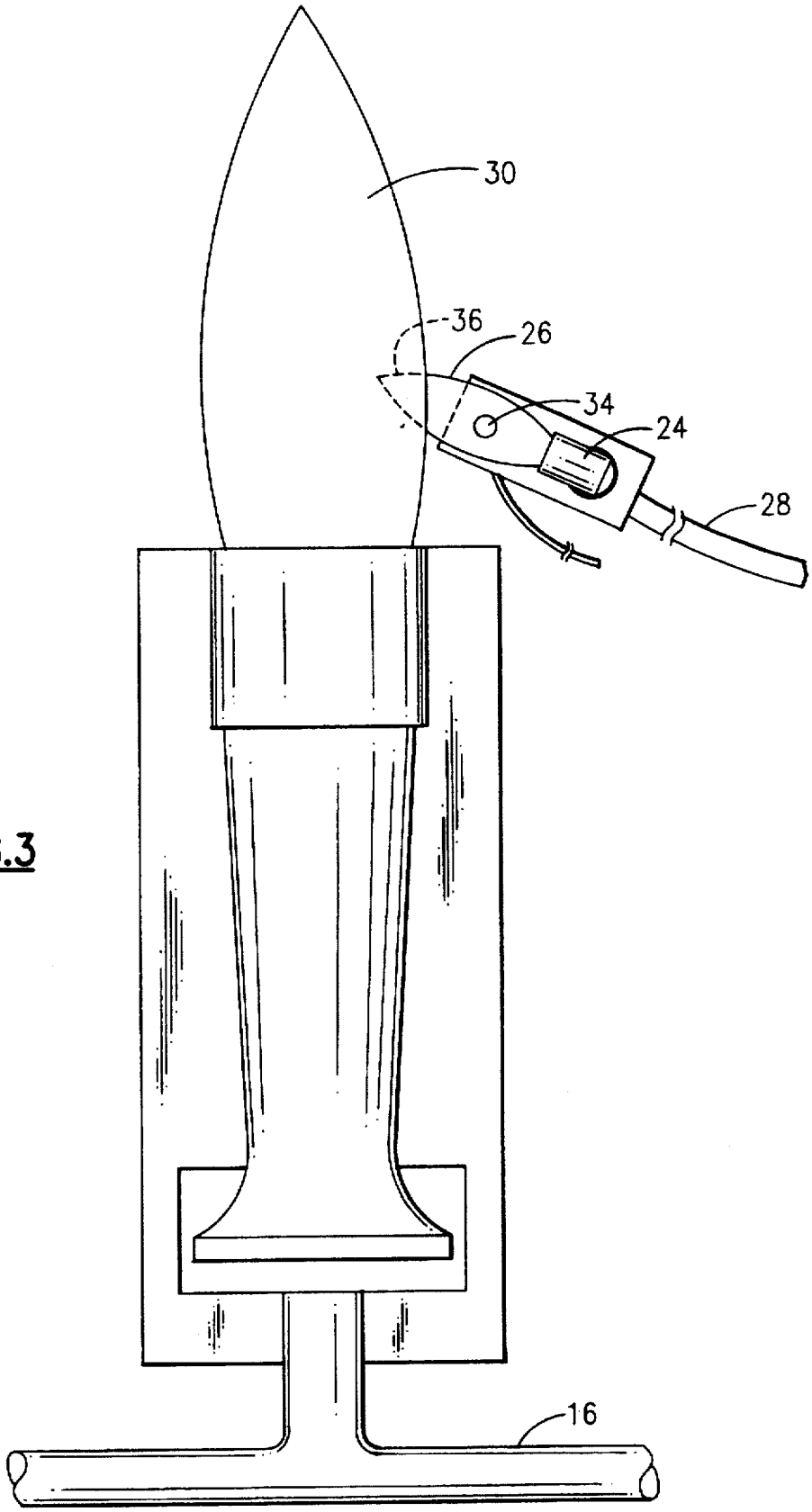
FIG. 3 is a plan view illustrating the relationship of the pilot burner to the gas burner of FIG. 1.

Referring to FIG. 3, the pilot flame 26 and main burner flame 30 are illustrated relative to each other in a plan view. The orientation of the pilot flame hood 24 relative to the main burner flame 30 is also illustrated. As can be seen, the pilot flame 26 is directed by the pilot flame hood into the path of the main burner flame 30. The pilot flame 26 extends into the path of the main burner flame 30 for a substantial distance so as to produce the requisite interaction with the main burner flame. This is accomplished by positioning the burner element 22 shown in FIG. 2 relative to the main burner element 14 so that the entire tip 36 of the pilot flame penetrates the outer periphery of the main burner flame 30. The degree of penetration is preferably such that at least ten percent of the pilot flame lies within the periphery of the main burner flame. Referring to the electrode 34, it is to be noted that the electrode is positioned relative to the pilot burner 22 and the main burner element 14 so as to be outside the periphery of the main burner flame 30 while at the same time being centrally located within the pilot flame 26.

Figure 4:
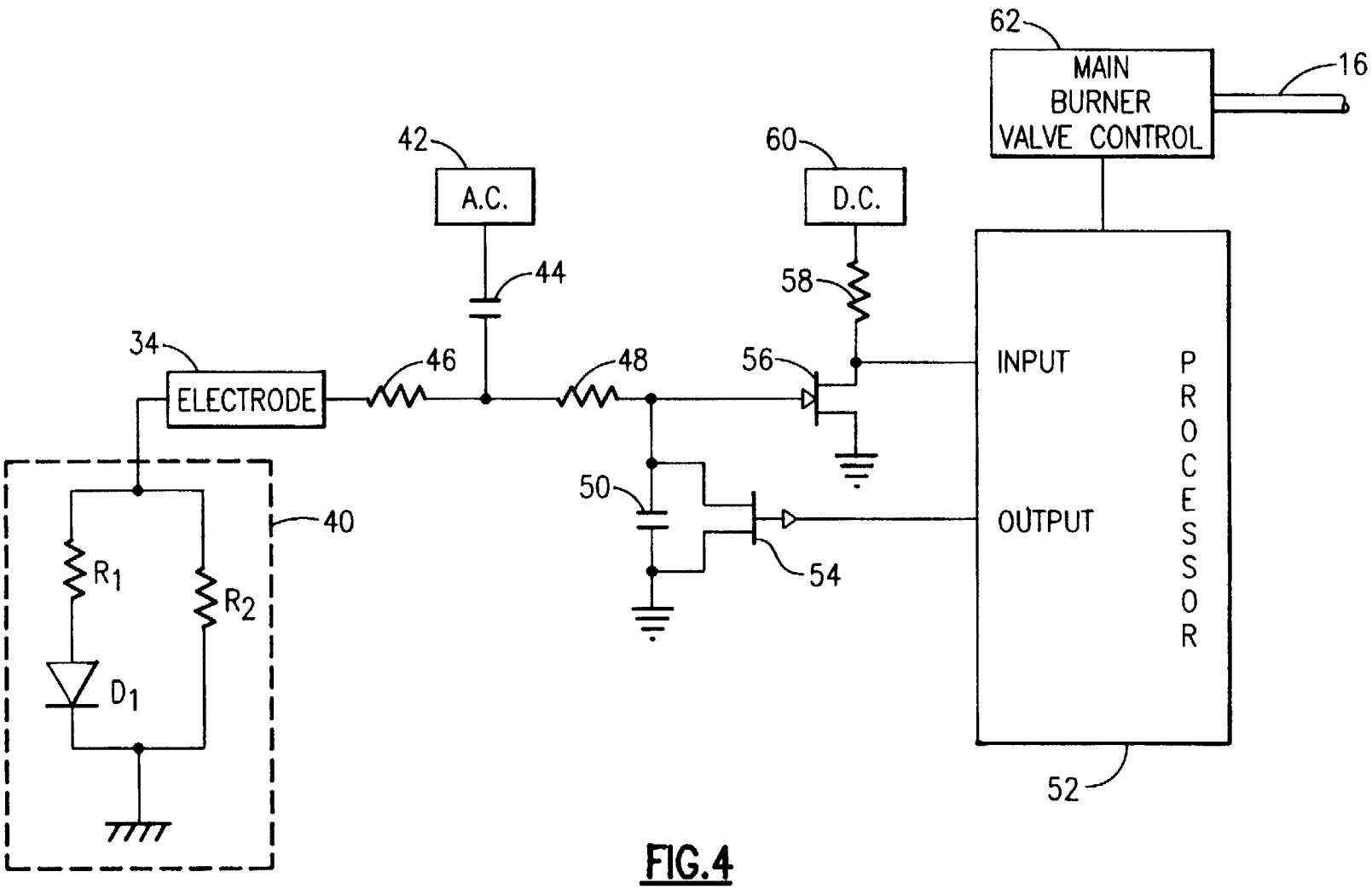
FIG. 4 illustrates flame sensor circuitry associated with an electrode located relative to the pilot burner of FIGS. 2 and 3.

Referring to FIG. 4, a pilot flame sense system including the electrode 34 is illustrated. An electrical analog circuit 40 of the pilot flame 26 is also illustrated in FIG. 4. The analog electrical circuit 40 is seen to include a resistor $R_1$ in series with a diode $D_1$ with this pair of components in parallel with a second resistor $R_2$. This resistor diode configuration defines the electrical current path from the electrode 34 through the flame 26 to ground defined by the pilot burner 22. As will be explained in detail hereafter, the flame 26 as represented by the analog circuit 40 will experience an AC voltage applied through the electrode 34. Due to the rectification effect of $D_1$, the current flow from the electrode 34 to ground will be greater when the applied AC voltage is positive as opposed to when it is negative. The AC voltage is applied to the electrode 34 by an AC power source connected to a capacitor 44 which is in turn connected to a resistor 46. The resistor 46 must be small relative to the resistance portion of the impedance of the flame analog circuit 40 so as to allow the voltage drop from the electrode 34 to ground to be larger than the drop across the resistor 46. It is therefore to be appreciated that the value of the resistor 46 will be a function of certain impedance values that must be measured for a particular pilot burner producing a particular pilot flame engulfing the electrode 34.

A resistor 48 and a capacitor 50 define another current path to ground. The resistor 48 and the capacitor 50 form a low pass filter and integrator for the voltage formed at the junction of the capacitor 44 and the resistor 46. The resistance value of the resistor 48 should be similar or greater than the resistance portion of the impedance of the flame 28 as reflected in the flame analog circuit 40. The capacitor 50 will integrate the current flowing through the resistor 48 so as to develop a voltage level reflecting the average voltage condition of the electrode 34. The amount of time taken to develop a given voltage at the capacitor 58 is a function of the current flowing through the resistor 48. As has been previously noted, the current flow through the resistor 46 and the electrode 34 will be higher when the AC voltage 42 is positive than when it is negative. Since capacitor 44 blocks DC current, this forces more current to flow through resistor 48 and capacitor 50 when AC voltage 42 is negative than when positive. This causes a negative DC voltage to build on capacitor 50 when flame is present.

The current through the flame will be higher when the intensity of the pilot flame increases due to the ignition of the main burner flame in the main burner elements adjacent to the pilot. This increase in current or electrical conductivity is due to increased flow rate of burning gas and conduction through the pilot flame to the main flame. This increased flame current due to the main burner builds negative voltage on capacitor 50 faster than pilot flame alone. To summarize the above, a timely establishment of a negative voltage condition for the capacitor 50 reflects or is an indicator of the presence and strength of flame at the electrode 34 due to the influence of the main burner flame.

The timely build up of a voltage across the capacitor 50 is measured by a microprocessor 52 in a manner which will now be described. The output of the microprocessor 52 is connected to a field effect transistor 54 having a P-channel JFET gate diode configuration. The transistor is in turn connected across the capacitor 50. The transistor 54 is operative to shunt the capacitor 50 in response to a logical low level signal from the microprocessor 52. When the logical low level signal from the microprocessor goes high, capacitor 50 will begin to charge at a rate determined by the intensity of the pilot flame 26. A field effect transistor 56 having an N-channel JFET gate diode configuration is responsive to the changing voltage condition present at the junction of the resistor 48 and the capacitor 50. The transistor 56 is in a conducting state until the average accumulated voltage across the capacitor 50 builds up following the shunting of the capacitor 50. When the transistor is in such a conducting state, a resistor 58 in combination with a DC voltage source 60 maintains an input to the processor 52 in a logical low state. When the capacitor 50 reaches a certain average accumulated voltage, the transistor 56 becomes nonconducting and the resistor 58 in combination with the DC voltage source 60 pulls the input to the microprocessor 52 to a logical high state. It is hence to be appreciated that the time the capacitor 50 takes to charge or integrate the current flowing through it to the accumulated voltage level causing the transistor 56 to become nonconductive will depend on the conductivity of the flame 26 as represented by the analog circuit 40. This degree of conductivity can be used to set an integration time for the capacitor 50 that reflects the particular condition to be sensed, namely the intensity of the flame 26 due to the presence of a burner flame in the burner flame element adjacent to the pilot flame.

Referring to the microprocessor 52, it is to be noted that the microprocessor is also operatively connected to a main burner valve control 62 so as to activate the main burner valve 18 when gas is to be supplied to the main burner via the gas supply line 16. It is to be understood that control of the valve 18 by a microprocessor is well known in the art of furnace control design.

Figure 5:
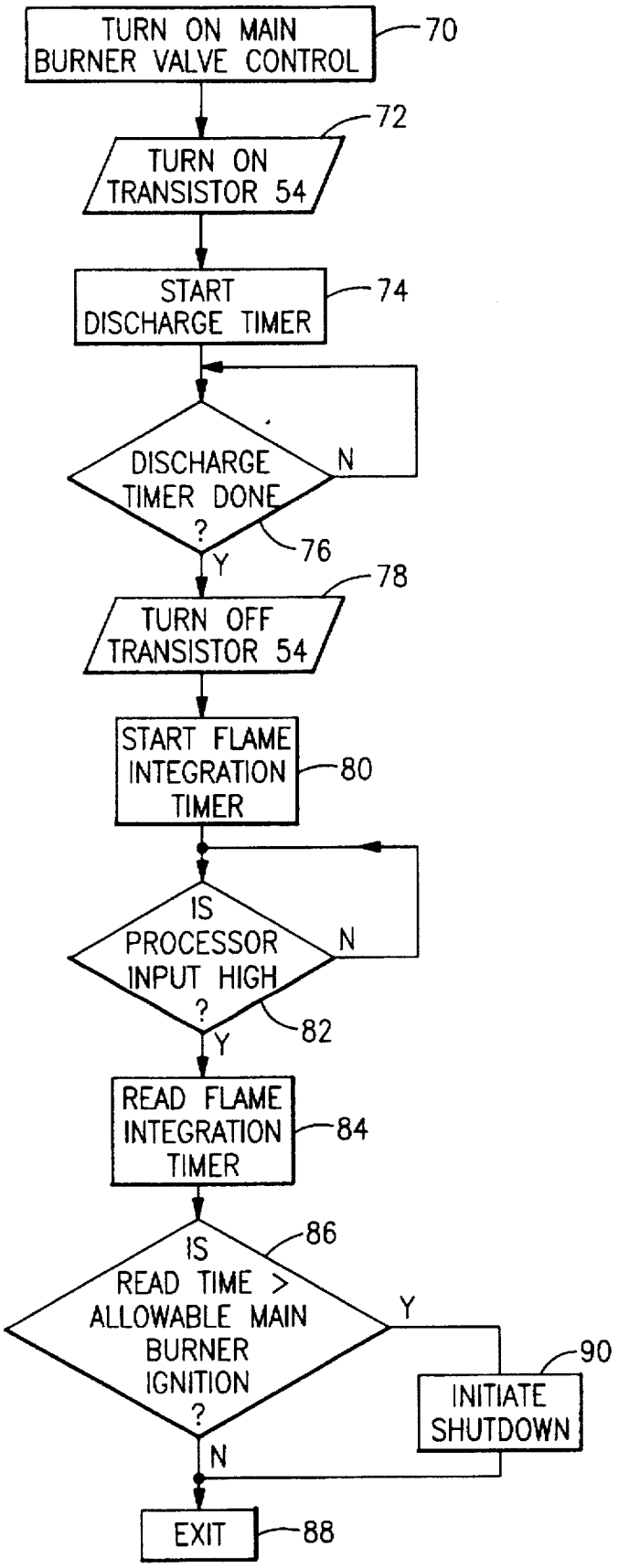
FIG. 5 illustrates a process executable by a microprocessor within the flame sensing circuitry of FIG. 4 for checking the electrical conductivity of the pilot flame.

Referring to FIG. 5, a pilot flame sensing program executable by a microprocessor 52 is illustrated. The flame sense program begins with a step 70 wherein the main burner valve 62 control is turned on. This is accomplished by sending an appropriate logic level signal to this control for the main burner valve 18. The microprocessor proceeds to a step 72 and turns the transistor 54 on by preferably sending a logically low level signal to the gate of this transistor. The microprocessor proceeds to a step 74 and starts a discharge timer. The discharge timer preferably defines an mount of time necessary for the capacitor 50 to essentially discharge to zero voltage. The microprocessor proceeds to a step 76 and inquires as to whether the discharge timer has expired thus indicating the voltage across the capacitor 54 to be essentially zero volts. When this occurs, the microprocessor proceeds along the yes path to a step 78 and turns the transistor 54 off by bringing the output of the microprocessor to a logical high level. The microprocessor next proceeds to a step 80 wherein a flame current integration timer is activated. The flame timer is preferably an incremental timer beginning at time zero. The microprocessor next proceeds to a step 82 and inquires as to whether the input associated with the transistor 56 is logically high. It will be remembered that this input is logically high at such time as the transistor 56 becomes nonconductive due to an appropriate buildup of voltage across the capacitor 50. When this input goes to a logical high level, the microprocessor proceeds to a step 84 and immediately reads the flame current integration timer. The microprocessor next proceeds to a step 86 and inquires as to whether the flame time read in step 84 is greater than an allowable main burner ignition time. The microprocessor will have previously stored such an allowable main burner ignition time in memory. This value of allowable main burner ignition time will have been previously established empirically by noting when the pilot flame increases in intensity to a level triggering the sensing circuit of FIG. 3 as a result of the occurrence of main burner ignition following activation of the main burner valve. Any permitted tolerance in this allowable time may also be added to this empirically established time. Referring to step 86, in the event that the read flame integration time is less than or equal to the allowable main burner ignition time, the microprocessor will proceed to an exit step 88. This will mean that the normal control of the furnace 10 will proceed on the premise that main burner ignition has in fact occurred.

Referring again to step 86, in the event that the read flame integration time is greater than allowable main burner ignition time, the microprocessor 52 will proceed to a step 90 and initiate a shutdown of the furnace on the premise that main burner ignition may not have occurred. This may ultimately lead to the furnace control again attempting to turn the main burner valve and again executing the flame sense program of FIG. 4.

It is to be appreciated that a particular embodiment of the invention has been described. Alterations, modifications and improvements thereto will readily occur to those skilled in the art. For instance, the circuitry of FIG. 4, which senses the electrical conductivity of the pilot flame, could be replaced with circuitry which senses the intensity of the flame in another way. One alternative embodiment would be circuitry that senses the intensity of the flame through noting an increase in the temperature of a probe. Mother alternative embodiment would be circuitry that senses flame intensity through optical sensing of the flame. Accordingly the foregoing description is by way of example only and the invention is to be limited by the following claims and equivalents thereto.

What is claimed is:

1. A system for sensing the ignition of a main burner of a gas furnace, said system comprising:

a pilot burner located adjacent at least one burner element of the main burner;

a hood attached to said burner for deflecting a pilot burner flame toward said main burner element; and a sensor for sensing the intensity of the pilot burner flame when gas is supplied to the main burner to determine whether the sensed intensity indicates that the main burner has been ignited.

2. The system of claim 1 wherein said sensor comprises:

circuitry for sensing the intensity of the pilot burner flame; and a computer connected to said circuitry for determining whether the sensed intensity of the pilot burner flame is indicative of main burner ignition.

3. The system of claim 2 wherein said computer connected to said circuitry is operative to initiate a shut down of the furnace when the sensed intensity of the pilot burner flame does not indicate main burner ignition.

4. The system of claim 2 wherein said computer is operative to trigger the sensing of the intensity of the pilot burner by said circuitry for sensing the intensity of the pilot burner flame after the activation of a main burner gas valve controlling the supply of gas to the main burner of the gas furnace.

5. The system of claim 4 wherein said circuitry for sensing the pilot burner flame comprises:

circuitry for measuring the electrical conductivity of the pilot burner flame whereby the measured electrical conductivity can be used by said computer to determine whether the measured electrical conductivity is indicative of main burner ignition.

6. The system of claim 5 wherein said circuitry for measuring the electrical conductivity of the pilot burner flame comprises:

an electrode positioned in the path of the pilot burner flame;

an alternating current voltage source upstream of said electrode producing an alternating current flown through the electrode and the pilot burner flame; and circuitry, responsive to the flow of the alternating current through the electrode and the pilot burner flame for indicating the degree to which the pilot burner flame is conductive whereby said computer is operative to determine whether the degree of conductivity is indicative of the main burner having ignited.

7. A process for determining the ignition of a main burner of a gas furnace, said process comprising the steps of:

noting when gas is provided to the main burner;

sensing the intensity of a flame emanating from a pilot burner associated with at least one burner element of the main burner; and determining whether the sensed intensity of the pilot burner flame is indicative of main burner ignition.

8. The process of claim 7 further comprising the step of:

initiating a shut down of the furnace on the premises that main burner ignition may not have occurred when the sensed intensity of the pilot burner flame is not indicative of main burner ignition.

9. The process of claim 7 wherein said step of noting when gas is provided to the main burner further comprises the step of:

noting the activation of a main burner valve controlling the supply of gas to the main burner of the gas furnace.

10. The process of claim 7 wherein said step of sensing the intensity of a flame emanating from a pilot burner associated with at least one burner element of the main burner comprises the step of:

measuring the electrical conductivity of the pilot burner flame following said step of noting when gas is provided to the main burner; and determining whether the measured electrical conductivity of the pilot burner flame is indicative of main burner ignition.

11. The process of claim 10 further comprising the step of:

initiating a shut down of the furnace on the premise that main burner ignition may not have occurred when the measured electrical conductivity of the pilot burner flame is not indicative of main burner ignition.

12. The process of claim 10 wherein said step of measuring the electrical conductivity of the pilot burner flame comprises the step of:

causing an alternating electrical current to travel through an electrode and the pilot burner flame; and charging an electrical capacitance upstream of the electrode as the alternating electrical current travels through the electrode to the pilot burner flame.

13. The process of claim 12 wherein said step of sensing the intensity of a flame emanating from a pilot burner associated with at least one burner element of the main burner further comprises the steps of:

monitoring the voltage build-up across the electrical capacitance upstream of the electrode; and noting the time it takes for the electrical capacitance to reach a predetermined charged level of voltage.

14. The process of claim 13 wherein said step of monitoring the voltage build-up across the electrical capacitance upstream of the electrode comprises the step of:

discharging the electrical capacitance to an initial voltage following said step of noting when gas is initially provided to the main burner; and monitoring the voltage buildup from the initial voltage following said step of discharging the electrical capacitance.

15. The process of claim 14 wherein said step of noting the time it takes for the electrical voltage to reach a predetermined charged level of voltage comprises the steps of:

initiating a timer following said step of discharging the electrical capacitance to an initial voltage;

noting the time of said timer when the electrical capacitance reaches the predetermined charged level of voltage.

16. The process of claim 15 wherein said step of determining whether the measured electrical conductivity of the pilot burner flame is indicative of main burner ignition comprises the step of:

comparing the time it takes for the electrical capacitance to reach the predetermined charged level of voltage with a predetermined allowable time for charging the electrical capacitance.

* * * * *